United States Patent [19]

Kane

[11] 4,095,546

[45] Jun. 20, 1978

[54] SHIPBOARD LNG TANKS

[76] Inventor: John R. Kane, 314 67th St., Newport News, Va. 23607

[21] Appl. No.: 815,790

[22] Filed: Jul. 14, 1977

[51] Int. Cl.[2] ..... B63B 25/14

[52] U.S. Cl. ..... 114/74 R; 114/74 A; 220/901

[58] Field of Search ..... 114/74 R, 74 A, 256, 114/257; 220/9 LG, 9 A, 1 B, DIG. 13; 52/80, 81

[56] References Cited

U.S. PATENT DOCUMENTS

| | | | |
|---|---|---|---|
| 2,655,888 | 10/1953 | Alcorn | 114/256 |
| 3,040,689 | 6/1962 | Brown | 114/74 A |
| 3,770,158 | 11/1973 | Alleaume | 220/9 LG |
| 3,894,505 | 7/1975 | Murphy | 114/74 A |

*Primary Examiner*—Trygve M. Blix
*Assistant Examiner*—Sherman D. Basinger
*Attorney, Agent, or Firm*—Martin Fruitman

[57] ABSTRACT

A rigid thin shell container for transporting liquified gas in marine tankers at near ambient pressure, constructed of completely developable flat plate, the contour of which is octagonal everywhere in horizontal section but curvilinear in side elevation, with eight sides linear in plan but curved vertically to form circularly or elliptically arched shell surfaces, intersecting in a point at the top, and connected at the base to an octagonal flat bottom which permits the container to be seated directly upon the insulated ship's innerbottom.

10 Claims, 3 Drawing Figures

SHIPBOARD LNG TANKS

BACKGROUND OF THE INVENTION

This invention relates to an improvement in large insulated containers for shipboard transportation of cryogenic liquified gas, such as liquified natural gas, at low or near atmospheric pressure. It has application particularly to single-walled metallic thin-shell type containers which do not require extensive internal stiffening to function satisfactorily. Such containers are supported directly in the ship by the simple expedient of sitting upon and being secured to the inner bottom of the ship's cargo holds, thus transferring the principal components of the cargo loading directly to the ship's structure in the most effective location via load-bearing insulation on the innerbottom.

The safe and efficient transportation of liquified gas, such as liquified methane at −260° F, presents special problems in the design of the containment system of the ship. Ordinary shipbuilding materials used in the hull structure suffer severe embrittlement at these temperatures, and an almost immediate brittle fracture of some of the hull structure would occur should the liquified cargo come in contact with it. Containers, or some kind of containment system, must therefore be used to contain the liquid cargo and keep it out of contact with the ship's hull. The containers must be made from special material suitable for the cryogenic temperature, such as, for example, aluminum alloy, 9% nickel steel, or 18-8 chromium-nickel stainless steel, which are costly to buy and fabricate. In addition, the containers must be supported in the ship in a manner to permit the significant thermal contraction of the container which will occur on cooling down when loading, and to minimize the interactions between the ship's structure and the tank itself due to cargo loading and ship response to wind and waves. Also, the containers must obviously be surrounded by an external jacket of insulation of sufficient thermal resistance to keep the temperature of the surrounding ship's structure from falling below the permissable transition temperature for satisfactory ductility for the type of structural steel used in the ship.

Two methods have commonly been used to accomplish the containment discussed above. One is to construct the cargo containment tanks of sufficient strength and rigidity to carry the liquid load independently, without assistance from the ship's structure except for support derived from some supporting apparatus or mounting system. The other is to construct the cargo containment of light or thin material not intended to be loaded appreciably in its own plane, but which contains the cargo by transmitting the liquid pressure perpendicular to the thin material to the structure of the ship's hold via the insulation. The former structures are usually referred to as independent, or self-supporting tank systems, while the latter are referred to as integrated, or membrane systems. This invention is exclusively concerned with a new concept of octangular curvilinear containers which is of the independent and self-supporting category, except for the light flat bottom portion of the container which derives support from the load-bearing insulation on the ship's innerbottom, and which may properly be called semi-membrane.

Large dimension flat bottomed tanks, such as those that are the subject of this invention, are best adapted to containing liquids where the gravity loading is the more important part of the cargo loading, and the internal back pressure on the surface of the liquid is low. Thus, they are well adapted to contain liquified natural gas which is normally stored at near atmospheric pressure, typically 1½ to 2½ psig, where such conditions apply. While there exists a considerable background of experience and technology for their use from the extensive application of flat bottomed cylindrical tanks to the storage of LNG ashore, such tanks must be modified and adapted significantly to meet the particular conditions and requirements aboard ship. In particular, whereas the designer of a shore tank usually has rather free use of the surrounding space so that he may proportion the tank as he sees fit to minimize construction and material costs, the designer of a shipboard container faces rather severe spatial constraints and must give full consideration to selecting proportions and a geometric shape which will result in an efficient and wholesome ship design as well as an economical and safe tank design. A primary purpose of the invention is, therefore, to provide an improved bottom-sitting container which has a geometric shape well suited to the usual range of ship proportions and cargo hold configurations of normal liquid bulk carrying ships, and to meet the operating and design requirements for the ship, as well as for the container, so as to result in an efficient and wholesome liquid gas tanker.

SUMMARY OF THE INVENTION

The present invention yields an independent-type shipboard tank which, by means of a novel geometry, provides a superior cargo containment volume for a prescribed height and breadth. Thus, a ship constructed for use with the containers of the present invention can be built with smaller cargo holds and with a lower profile than ships of the same cargo capacity built to hold curvilinear containers of former designs. Moreover, as would usually be preferred, the tanks can be contained completely belowdecks and the weather deck left free of large penetrations.

The following table compares the heights and breadths of a container of the present invention to three other recently patented shipboard container designs of identical volume.

Column A represents the dimensions of the present invention. Column B shows the dimensions for a full spherical tank as depicted in U.S. Pat. No. 3,677,021. Column C lists the dimensions for the coni-spherical spheroid with a truncated base of U.S. Pat. No. 3,859,805. Column D refers to U.S. Pat. No. 3,842,775, which describes a vertical cylindrical tank with hemispherical head and shallow conical base.

DIMENSIONS OF EQUAL VOLUME TANKS

| | A Octagonal | B Spherical | C Coni-Spherical | D Hemi-Cylinder |
|---|---|---|---|---|
| Height | 0.770 | 1.0 | 0.90 | 0.98 |
| Breadth | 0.979 | 1.0 | 1.03 | 0.98 |

It is clear from the above comparison that the present invention yields particular benefits in reduced height of the container, and better utilization of the normal cargo hold of bulk carrier ships, which in turn yields less expensive and more stable ships.

The present invention embodies a configuration in which the complete shell of the container can be constructed from simple developable flat plate composites which require curvature in the vertical plane only. The form of the vessel is octagonal everywhere in horizontal section, but curvilinear in side elevation, with eight sides linear in plan view but curved vertically with a single plane curvature to form circularly or elliptically arched shell surfaces, contiguous to one another and intersecting in a point at the top vertical centerline of the container. The sides are connected at the base to an octagonal flat plate bottom which can be of lighter weight and greater flexibility than the sides since it derives its support from the ship's innerbottom. The cross-sectional contour of the container as determined by vertical planes intersecting the central axis of the container and positioned either longitudinally or transversally relative to the ship will be similar circles, or oblate ellipses, if ship fit makes the latter desirable. Such sections must be truncated at a carefully selected lower point to provide the most advantageous point for bottom sitting, taking into account all the load conditions. This type of container is easy to fabricate, and can be shown to be especially well suited to fit the geometric, stability, operational and shipbuilding requirements of the ship.

DETAILED DESCRIPTION OF THE INVENTION

Figure 1:
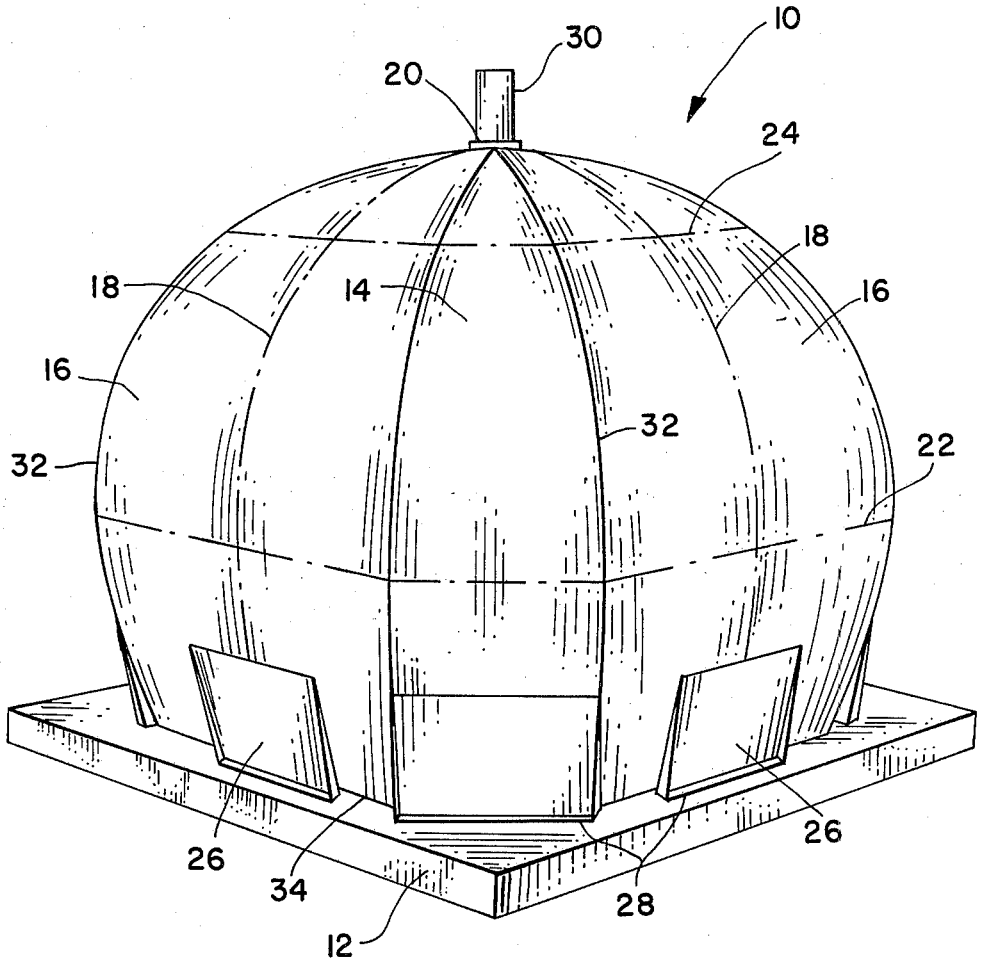
FIG. 1 is a perspective view of the octagonal container of the invention sitting upon a portion of a ship's innerbottom.
Figure 2:
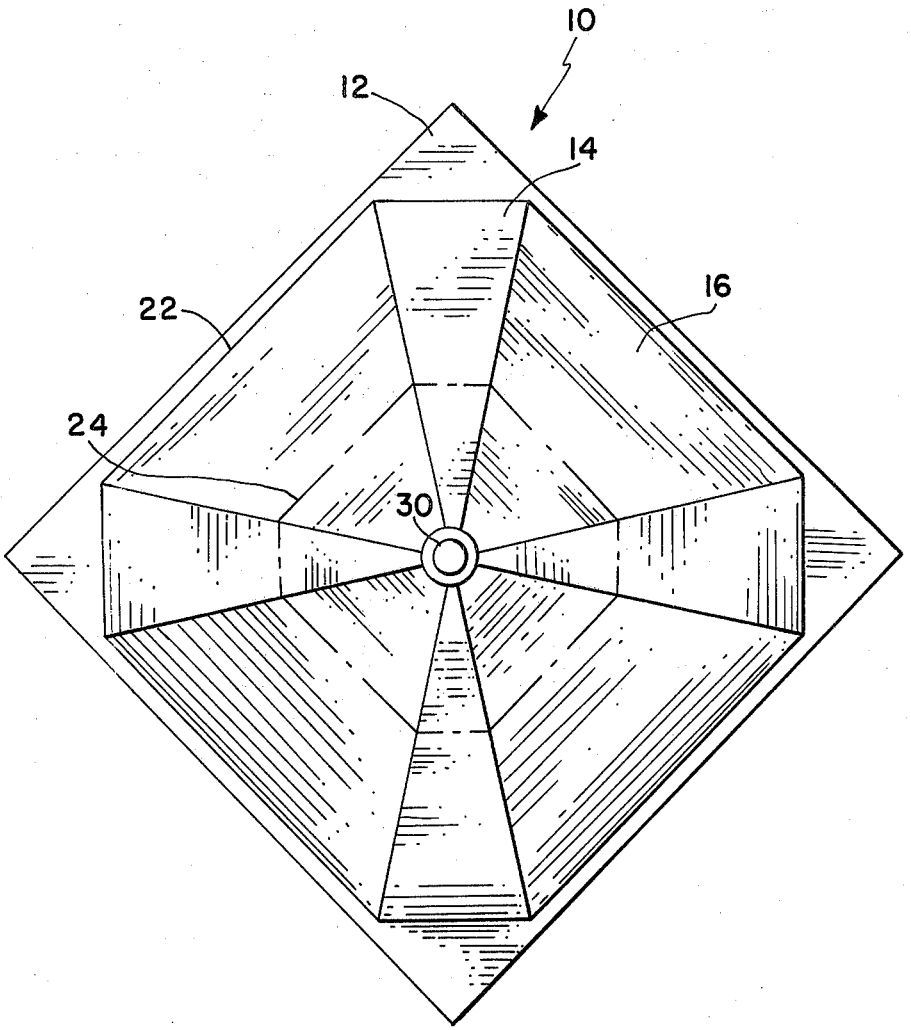
FIG. 2 is a plan view of the container of the invention.

The essential concept of the present invention is shown in perspective in FIG. 1 and in plan view in FIG. 2 in which octagonal container 10 is depicted sitting upon a section 12 of the ship's cargo hold innerbottom. Container 10 is formed from eight plates of two configurations. Smaller plates 14 comprise four sides of the container and larger plates 16 comprise the other four sides. Smaller plates 14 and larger plates 16 are all formed from flat plates formed into a gentle curve in the vertical plane only. Typical vertical profile lines 18 are shown as they would be formed by an imaginary vertical plane intersecting larger plates 16 perpendicularly while passing through apex 20 of container 10.

Maximum horizontal profile 22 and typical horizontal profile 24 are formed by imaginary horizontal planes as they intersect the container sides. Horizontal profiles 22 and 24 are similar octagons of different scale dimension, the dimensions depending on the height of the horizontal plane above the ship bottom. Maximum horizontal profile 22 determines the maximum breadth dimension of container 10, which is the perpendicular distance between the longer sides 16, which are located longitudinally and transversally in the ship.

Conventional hold down straps 26 are provided, one to each of the eight sides, secured to appropriate hold down flanges 28 attached to ship interbottom 12. Hold down straps 26 are attached to flanges 28 at their bottom and welded to the container at their top at a sufficient height to absorb in bending the thermal contraction and expansion of the container. Cylindrical loading hatch 30 is furnished at apex 20 to provide for attachment to typical equipment for loading used in liquified gas carriers. Junctions 32 between plates 14 and 16 are of conventional construction, such as welds, well known in the shipbuilding and pressure vessel industries.

Vertical profile lines 18, maximum horizontal profile line 22, and the point at which container 10 is truncated to form flat bottom 34 completely determine the shape of container 10. They are independent variables which can, within proper limits, be selected or adjusted to permit the best compromise in design for the container and the ship in combination.

Vertical profile lines 18 may be circular or moderately oblate elliptical. The oblate elliptical contour yields slightly less depth and greater beam of the ship without much sacrifice in regard to stress analysis and container weight.

The preferred design of tank 10 would normally be such that vertical profile lines 18 are circles truncated at selected points in their lower halves. This is so, not only because of simplicity in design analysis but also for simplicity in layout and construction. It also results in good proportions for most ship designs. If, however, the ship design for some reason should favor a broader beam, lesser depth ship, the selected contour can be an oblate ellipse, truncated in similar fashion, without a tremendous increase in complexity. In either case, the point at which the contour is sliced off for bottom sitting is not a matter of arbitrary choice but must be made within narrow limits, based upon analysis of the more critical loading conditions for the container, and the balance that must be established between excessive hold-down forces in the anchoring system for the container, on the one hand, versus excessive compressive stresses in the lower base of the container on the other.

For example, for an octagonal container of this invention with circular cross section 18, where the circle is described in polar coordinates with the polar angle measured from the upper vertical axis of the container, it can be shown that the average meridional membrane stress in the side walls will be neutral, i.e., just changing from tension to compression, when the polar angle equals 120° and the container is just full of liquid but no additional internal pressure is present. With the container full of liquid, but with a back pressure of $2\frac{1}{2}$ psig acting on the surface of the liquid due to the vent system relief valves, the neutral point will occur at a polar angle of 126°. These balance points occur when the weight of the contained liquid is in equilibrim with the pressure forces due to hydrostatic pressure plus the internal pressure on the liquid surface acting on an area equal to that of the flat bottom. The best balance between the opposing forces mentioned will usually be secured with a point of truncation in the range of 120° to 130° depending upon the venting pressure, loading conditions, and other variables.

With respect to the second independent shape variable, the octagon which establishes the octangular shape of the container in plan view, it is assumed that the larger sides 16, those longitudinally and transversally oriented in the ship will be equal in length and perpendicular to each other. However, they can, and generally should be significantly longer than smaller sides 14, which complete the octagonal contour. The space utilization of the square cross-section of the ship's cargo hold will be thereby substantially improved. A study of the most efficient octagonal proportions, i.e., the best ratio of the length of the longer sides, *a*, to the shorter sides, *b*, conducted from the point of view of maximizing the volume of the container divided by its surface, indicates that an optimum exists at a ratio *a/b* of 3.2 to 1, and that the octagonal shape is more efficient as regards volume per unit surface than a body of revolution type container with the same vertical cross-section 18. The octagonal body with longer and shorter sides is everywhere more efficient in this respect than the body of revolution except at the two limits, first where it approaches a regular octagon with all sides equal, and secondly where it approaches a square horizontal section vessel of the same vertical contour 18. At these two limits, the efficiency of the octagonal vessel as regards volume/surface is identical to that of the body of revolution generated by the same vertical contour 18. The optimum referred to above is, however, relatively flat, and a range of *a/b* from 2 to 5 can be used for the octagon with not more than 0.5% loss in volume for a given surface, and with assurance of at least 3% greater volume than for a spheroid of revolution.

Illustrating the above, an octagonal container which has a ratio of the longer sides to the shorter of 3 to 1, and which is truncated at a polar angle of 125° from vertical upright, has a volume 6.67% greater than a full spherical tank of the same width, and 8.8% less surface when the area of the free standing structure only is considered. When the octagonal bottom and hold-down straps are included in the surface area of the octagonal tank, and the supporting skirt is included in the area of the full spherical tank, the total area for the octagonal container is 12% less than that for the spherical tank. While both containers will fit the same cargo hold in plan view, the full sphere has a height 27% greater than the octagonal tank. When the same octagonal container is compared to the circumscribed spheroid of revolution comparable to it, both truncated at the same point and sharing vertical contour 18, the octagonal tank has a volume 21% greater than the spheroid of revolution, yet it has a surface area only 17% greater than the spheroid. These are significant factors in the economic design of the ship.

Figure 3:
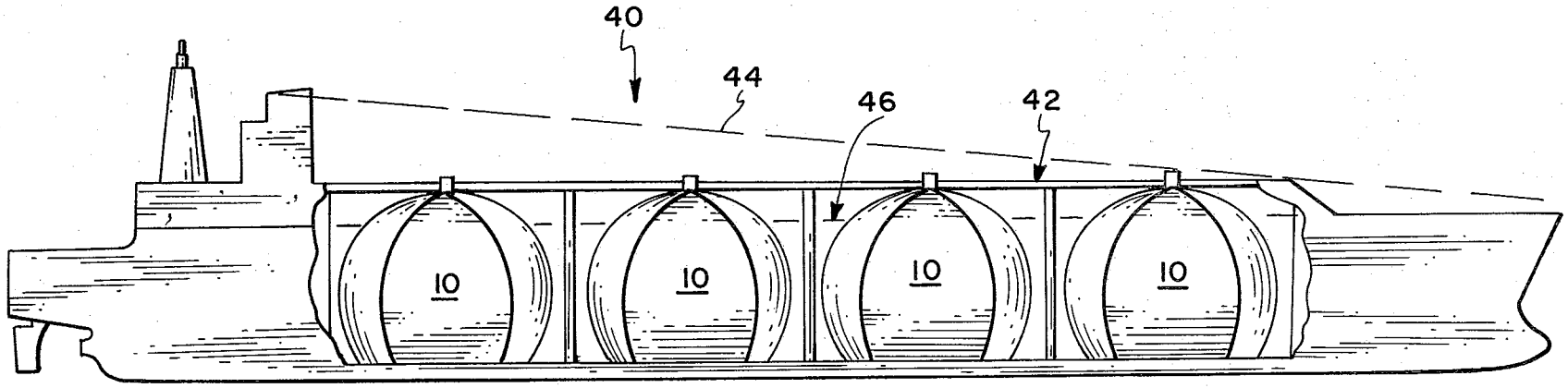
FIG. 3 is a cutaway profile view of a liquified natural gas carrier ship proportioned to transport liquid cargo in a multiplicity of the octagonal containers of the invention.

FIG. 3 shows a cutaway profile of a liquified natural gas carrier ship 40 designed to accommodate four octagonal containers 10, in a scale typical of that required to transport 120,000 to 130,000 cubic meters of liquified gas, a popular size at present. The ship would have slightly less length and slightly more beam than one carrying the same amount of cargo in five full spherical tanks, which is customary at present. The savings in fabrication and installation costs of four tank units in lieu of five are obvious. The profile clearly shows the ability to stow the containers completely below a shallow trunk deck 42, thus permitting a ship design similar to that used in membrane type tankers (in which the shape of the tank is not a constraint upon the ship design). Sight line 44 shows the line of sight dead ahead from the helmsman's station. Unlike the view from that position on LNG carriers with full spherical tanks, the blind area directly ahead of the bow of the ship is less than one ship length. A further advantage of the ship design is the availability of ample area 46, below deck and under the gunwhales of the ship, for fore and aft passages for pedestrian use in foul weather and for running piping and other auxiliary services fore and aft.

It is to be understood that the form of this invention as shown is merely a preferred embodiment. Various changes may be made in the function and arrangement of parts; equivalent means may be substituted for those illustrated and described; and certain features may be used independently from others without departing from the spirit and scope of the invention as defined in the following claims.

What is claimed as new and desired to be secured by Letters Patent of the United States is:

1. A self supporting tank for containing low-pressure liquids aboard ships comprising:

eight sides curved in vertical planes and linear in all horizontal planes, four non-adjacent sides of which are dimensionally equal to each other and larger in horizontal dimensions than the other four sides, which are dimensionally equal to each other, each of said eight sides being attached to adjacent sides by conventional methods and all meeting at an apex at their highest points, forming a container with octagonal cross-sections in all horizontal planes; and a horizontal octagonal flat plate attached to the eight sides thereby truncating the volume, forming a bottom of the tank and completing the enclosure.

2. A self supporting tank for containing low-pressure liquids aboard ship as in claim 1 wherein the curve in the vertical planes is circular.

3. A self supporting tank for containing low pressure liquids aboard ship as in claim 2 wherein the horizontal octagonal flat plate bottom is located in a plane intersecting the vertical circular curves between 120° and 130° from the highest point of the circles.

4. A self supporting tank for containing low pressure liquids aboard ship as in claim 1 wherein the curve in the vertical plane is oblate elliptical.

5. A self supporting tank for containing low pressure liquids aboard ship as in claim 1 wherein the ratio of the length of the larger sides to the length of the smaller sides in the horizontal planes is selected to maximize the ratio of the tank volume to the tank surface.

6. A self supporting tank for containing low pressure liquids aboard ship as in claim 1 wherein the ratio of length of the larger sides to the length of the smaller sides in the horizontal planes is in the range between 5 to 1 and 2 to 1.

7. A self supporting tank for containing low pressure liquids aboard ship as in claim 1 wherein the ratio of the length of the larger sides to the length of the smaller sides in the horizontal planes is approximately 3 to 1.

8. A self supporting tank for containing low pressure liquids aboard ship as in claim 1 wherein the horizontal octagonal flat plate bottom is located in a plane selected to balance the stress in the tank sides.

9. A self supporting tank for containing low pressure liquids aboard ship as in claim 1 wherein the horizontal octagonal flat plate is located in a plane such that the average meridional membrane stress in the side walls at the point where they connect to the bottom approaches neutral.

10. A self supporting tank for containing low pressure liquids aboard ship as in claim 1 wherein the horizontal flat bottom plate derives its support from the ship bottom.

* * * * *